US009284021B2

(12) United States Patent
Santa Catarina

(10) Patent No.: US 9,284,021 B2
(45) Date of Patent: Mar. 15, 2016

(54) PORTABLE CATAMARAN VESSEL

(76) Inventor: Mateus Frois Santa Catarina, Rio de Janeiro-RJ (BR)

( * ) Notice: Subject to any disclaimer, the term of this patent is extended or adjusted under 35 U.S.C. 154(b) by 0 days.

(21) Appl. No.: 14/372,007

(22) PCT Filed: Mar. 16, 2012

(86) PCT No.: PCT/BR2012/000073

§ 371 (c)(1),
(2), (4) Date: Jul. 11, 2014

(87) PCT Pub. No.: WO2013/104032

PCT Pub. Date: Jul. 18, 2013

(65) Prior Publication Data

US 2015/0000577 A1 Jan. 1, 2015

(30) Foreign Application Priority Data

Jan. 13, 2012 (BR) ..... 0005620

(51) Int. Cl.

| | |
|---|---|
| ***B63B 1/00*** | (2006.01) |
| ***B63B 7/00*** | (2006.01) |
| ***B63B 1/12*** | (2006.01) |
| ***B63B 7/08*** | (2006.01) |
| ***B63B 15/00*** | (2006.01) |
| ***B63B 17/00*** | (2006.01) |
| ***B63H 9/00*** | (2006.01) |
| ***B63B 35/73*** | (2006.01) |

(52) U.S. Cl.

CPC . *B63B 7/00* (2013.01); *B63B 1/121* (2013.01); *B63B 7/082* (2013.01); *B63B 15/0083* (2013.01); *B63B 17/00* (2013.01); *B63B 35/73* (2013.01); *B63H 9/00* (2013.01); *B63B 2739/00* (2013.01)

(58) Field of Classification Search

USPC ..... 114/61.1, 61.22, 61.25
IPC ..... B63B 1/121,7/082, 7/00
See application file for complete search history.

(56) References Cited

U.S. PATENT DOCUMENTS

| | | | | |
|---|---|---|---|---|
| 3,571,831 | A * | 3/1971 | Conklin | 441/45 |
| 4,782,777 | A * | 11/1988 | Sussman | 114/39.26 |
| 2007/0295255 | A1* | 12/2007 | Stryjewski et al. | 114/61.22 |
| 2010/0095877 | A1* | 4/2010 | Scadden | 114/61.25 |

* cited by examiner

*Primary Examiner* — Stephen Avila

(57) ABSTRACT

The present invention relates to a portable boat with catamaran configuration. The boat basically consists of two inflatable floats joined by two connecting bars with plates at their ends for fastening the connecting bars to the floats. A rigid platform can be assembled between the two connecting bars, forming a deck for the occupant. The present invention allows the occupant to remain standing on the rigid platform while using a paddle to propel the boat. The lateral floats provide greater stability, making it easier for the occupant to keep his balance. Removable fins can be mounted on the rear underside of each float to help keep a straight path and improve performance (decreasing zigzags, and allowing a greater number of paddle strokes before having to change sides). The boat exhibits high hydrodynamic efficiency and can be disassembled so as to occupy a small volume, making it easy to transport and store.

1 Claim, 5 Drawing Sheets

PORTABLE CATAMARAN VESSEL

CROSS-REFERENCE TO RELATED APPLICATIONS

The present application claims the benefits of PCT/BR2012/000073, filed on Mar. 16, 2012, and Brazilians Applications BR No. PI0005620, filed on Jan. 13, 2012, both of which are entitled "BARCO CATAMARA PORTATIL" translated here to "PORTABLE CATAMARAN VESSEL", and are incorporated herein by reference in their entireties.

FIELD OF THE INVENTION

The present invention relates to the field of small boats.

SUMMARY OF THE INVENTION

The present invention relates to a portable boat having a catamaran configuration. It basically consists of two inflatable floats 1 that are joined by two connecting bars 2 which have plates 5 on their ends to their attachment to the floats 1. A rigid platform 3 can be assembled between the two connecting bars 2, forming a deck for the occupant. The present invention can be used as an alternative to stand-up paddle boards, allowing the occupant to be positioned standing on the rigid platform while using a paddle to propel the boat. The floats 1 provide lateral stability, which allows the balance of the occupant. The boat has high hydrodynamic efficiency, reaching speeds equivalent to those conventional stand-up paddle boards. In addition to these advantages, the boat can be disassembled to occupy a small volume, making it easy to transport and store.

Removable fins 11 can be installed at the lower rear of each of floats 1, helping to maintain a straight path, which enhances the performance (decreasing zigzags, and allowing a greater number of paddle strokes before having to change sides).

Researching the current state of the art related to the field of the present invention, we can cite the U.S. Pat. No. 5,189,974A, which describes a boat consisting of two kayaks arranged in catamaran configuration and joined by two sidebars. This boat should be used preferably by two occupants positioned on each comprising kayak. U.S. Pat. No. 6,112,692A and US2004112266A1 describes a boat consisting of a kayak that has a double hull to provide stability, similar to a catamaran boat. All patents cited above refers to boats using rigid hulls, unlike the present invention that uses inflatable floats. The U.S. Pat. No. 4,496,325, U.S. Pat. No. 4,766,830, U.S. Pat. No. 4,782,777 and U.S. Pat. No. 5,042,411 describe boats using two inflatable floats, arranged in a catamaran configuration, which are joined by a deck structure that function similarly to the present invention. However, the present invention introduces innovation that simplifies the boat, reducing production costs without compromising performance. The boat of the present invention is easier to assembly and occupies a smaller volume when disassembled in relation to the current state of the art.

BRIEF DESCRIPTION OF THE DRAWINGS

The preferred embodiments of the present invention will now be described, by way of non-limiting examples of the invention, with reference to the attached drawings. In the drawings.

DETAILED DESCRIPTION OF THE INVENTION

Figure 1:
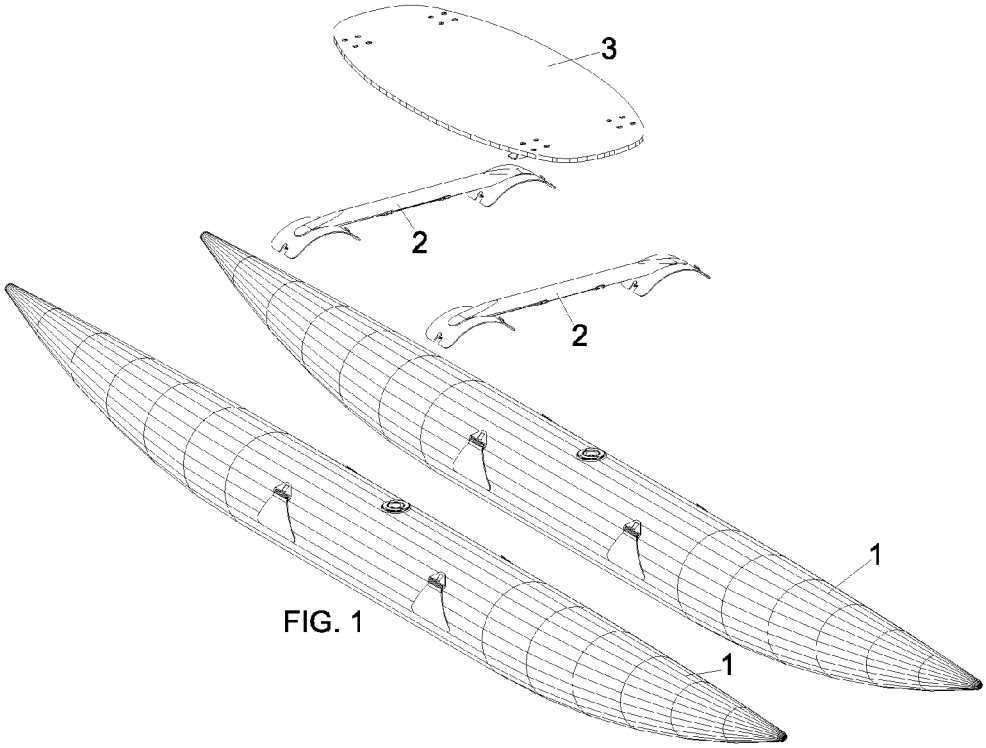
FIG. 1 is an exploded perspective view of a boat according to the invention "portable catamaran vessel"

FIG. 1 shows an exploded perspective view of the present invention showing the items that compose it. The boat comprises two floats (1), two connecting bars (2) and a rigid platform (3). The rigid platform (3) may have different formats, and can even provide seats, oar mounts, mast base for windsurfing sail, holders for accessories etc.

Figure 2:
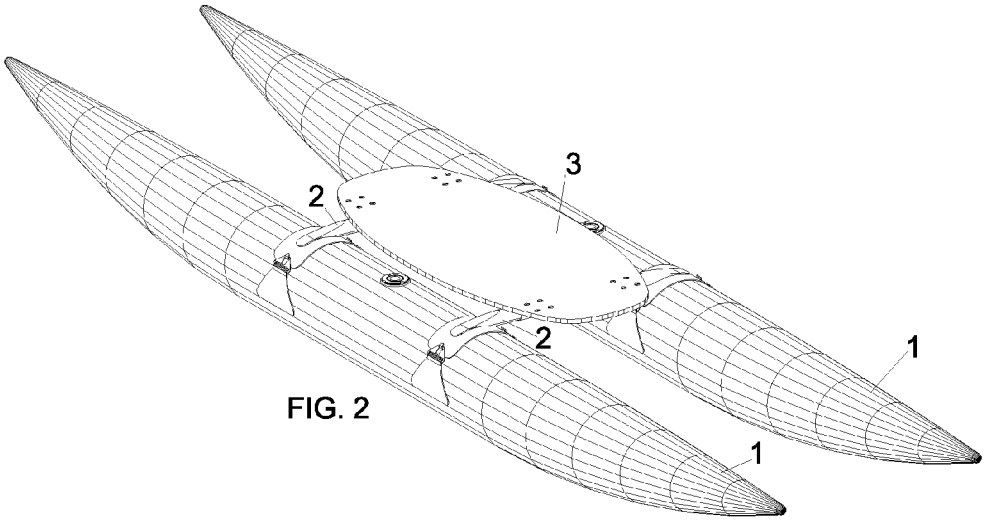
FIG. 2 is a perspective view of a boat according to the invention "portable catamaran vessel"

FIG. 2 shows a perspective view of the present invention.

Figure 3:
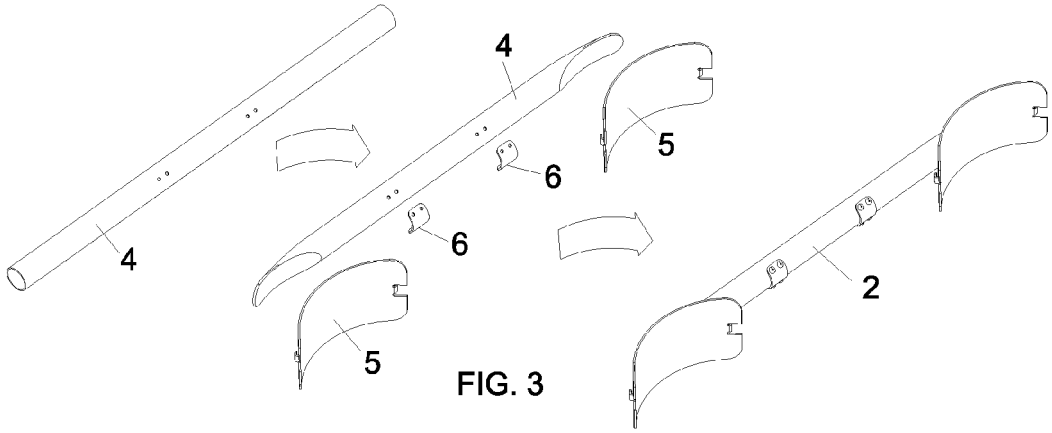
FIG. 3 consists of figures illustrating the details of the manufacturing process of connecting bars of a boat according to the invention "portable catamaran vessel"

FIG. 3 illustrates the process of manufacturing connecting bars (2). The connecting bars (2) are manufactured through five parts: a tube (4), two plates (5) and two stops (6). Initially, the ends of the tube (4) must be conformed mechanically. Subsequently the plates (5) are joined by rivets or welding to the ends of the previously conformed tubes (4). Two stops (6) are riveted to the tube (4).

Figure 4:
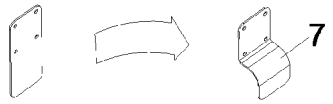
FIG. 4 consists of figures illustrating the details of the manufacturing process of mounting brackets of the rigid platform of a boat according to the invention "portable catamaran vessel"
Figure 5:
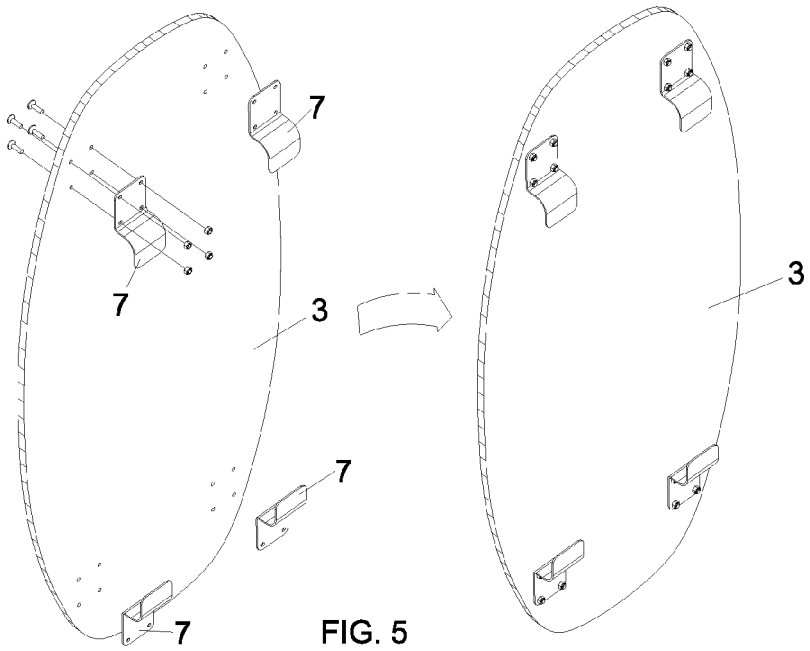
FIG. 5 consists of figures illustrating the details of fixing the mounting brackets on the rigid platform of a boat according to the invention "portable catamaran vessel"

The rigid platform (3) has four mounting brackets (7) fixed to the underside of it. The mounting brackets (7) can be manufactured from a plate that is cut and conformed mechanically as detailed in FIG. 4. Subsequently the four mounting brackets (7) can be fixed by nuts and bolts to the rigid platform (3), as shown in FIG. 5.

Figure 6:
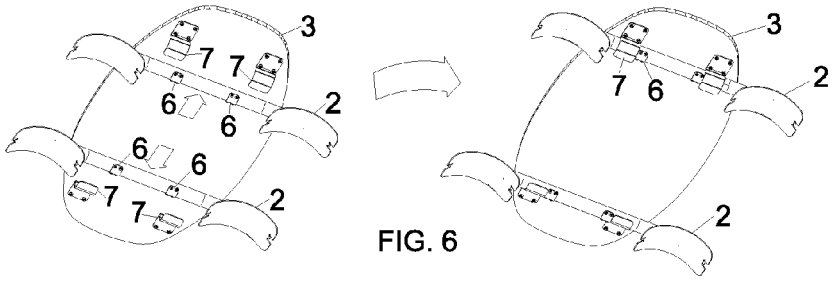
FIG. 6 consists of pictures illustrating the process of engagement of the connecting bars in the rigid platform of a boat according to the invention "portable catamaran vessel"
Figure 7:
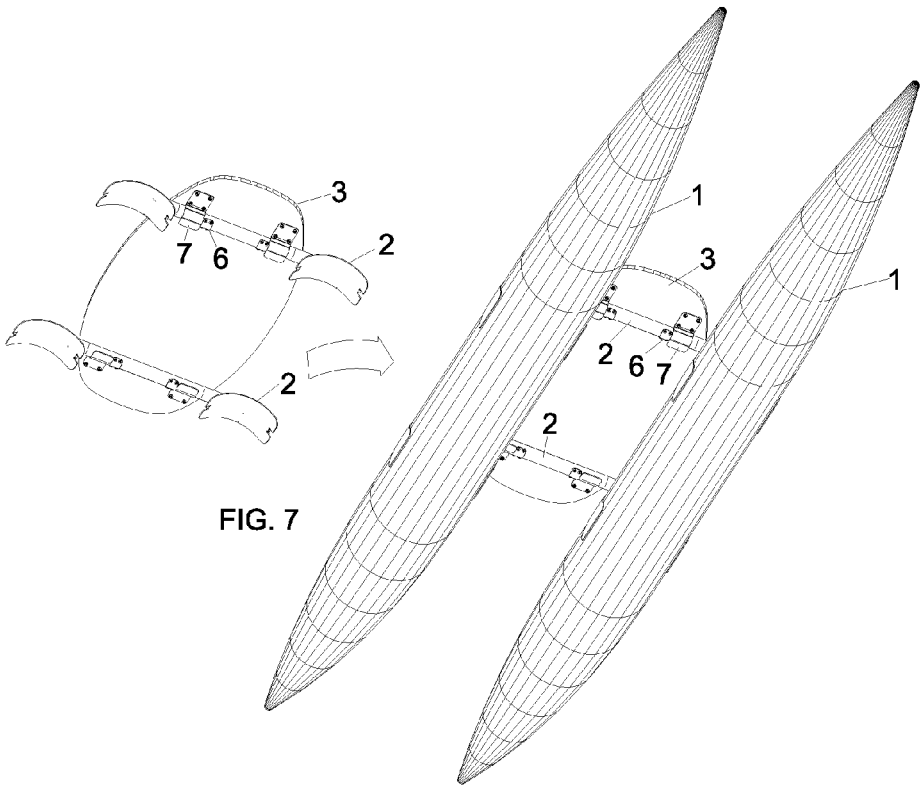
FIG. 7 consists of figures illustrating the process of mounting the float in the connecting bars of a boat according to the invention "portable catamaran vessel"

The mounting brackets (7) are arranged so as to enable the two connecting bars (2) be fitted by a simple longitudinal movement of engagement, as suggested by the arrows in FIG. 6. When fitted, the connecting bars (2) are in parallel and have restriction of all movements of translation relative to the rigid platform (3), except for the longitudinal movement of disengagement. The stops (6) of the connecting bars (2) do stop with the four mounting brackets (7) preventing lateral displacement of the rigid platform (3) in relation to the connecting bars (2). With the fitting of floats (1) to the connecting bars (2), as shown in FIG. 7, the longitudinal translation movement is restricted, joining together all items included in this boat, the two floats (1), the two connecting bars (2) and the rigid platform (3), eliminating any possibility of movement between them. The boat turns into a single body.

Figure 8:
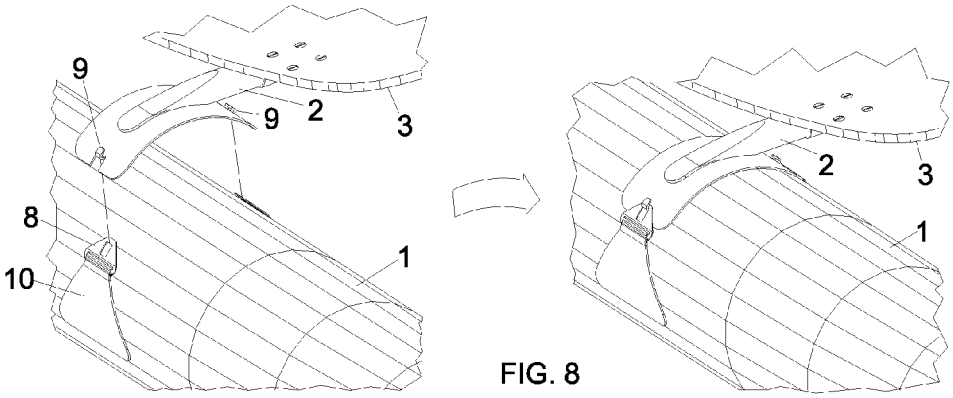
FIG. 8 consists of figures illustrating the principle of engagement of the connecting bars to the floats of a boat according to the invention "portable catamaran vessel"

FIG. 8 shows the detail of how the connecting bars (2) are attached to the floats (1). The procedure consists of setting the buckles (8) on hooks (9) present in the connecting bars (2). This operation must be performed with floats (1) in the semi-inflated condition. After performing this operation, the floats (1) must be completely inflated, so that due to the expansion thereof, the belts (10) always remains tensioned, ensuring fixation. For removal should proceed in reverse.

Figure 9:
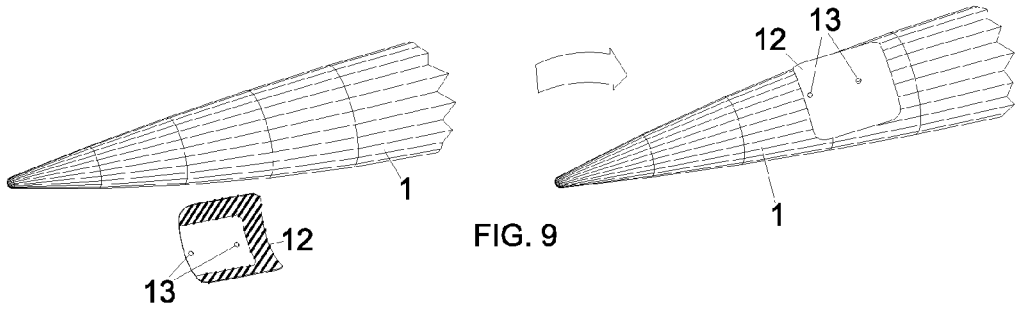
FIG. 9 consists of figures illustrating the attachment of a pocket in the float of a boat according to the invention "portable catamaran vessel"

The following will show a technique for installing removable fins (11) on the bottom rear of each float (1). A pocket (12) is permanently fixed on the float (1), as shown in FIG. 9. The pocket (12) is made of the same fabric that the floats (1) are made. It has preferably a rectangular shape and rounded edges to minimize the possibility of detachment. Pocket (12) also has two holes (13) and it is welded or glued on edges and front side (cross hatched region), as shown in FIG. 9. At the time of fixing the pocket (12) at the bottom rear of the float (1) holes (13) are positioned in a manner aligned with the longitudinal axis of the float (1) and pocket (12) should be set stretched, which means that the area of the float (1) which is hidden behind the pocket (12) is equal to the area of the pocket (12). Thus, when the float (1) is inflated, the inner region of the pocket (12) is pressed. This inner region of the pocket (12) takes the form of a cylindrical shell of rectangular shape, allowing a shell plate with this format can be installed.

Figure 10:
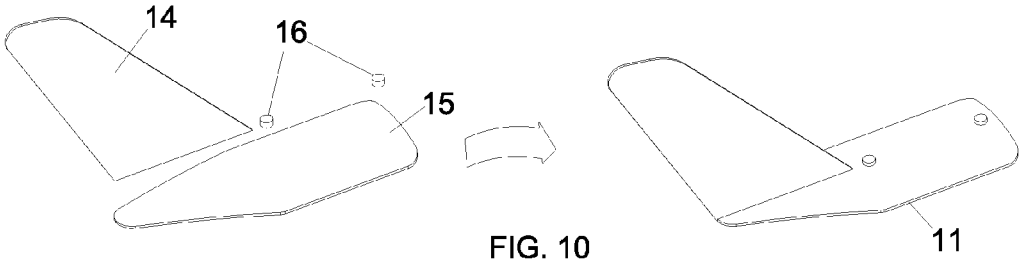
FIG. 10 consists of figures illustrating the components of a removable fin of a boat according with the invention "portable catamaran vessel"

As shown in FIG. 10, the removable fin (11) is a single body that can be manufactured by different manufacturing processes and is composed of the semi-wing (14) which is fixed to the convex region of the triangular part of the cylindrical shell (15). The cylindrical shell (15) has a rectangular region with dimensions and curvature similar to that assumed by the inner pocket (12) when the float (1) is inflated. Two pins (16) are fixed to the convex region of the cylindrical shell (15). These pins (16) have the same diameter of the holes (13) inside the pocket (12) and height slightly greater than the thickness of the pocket (12) fabric. The distance between the centers of the pins (16) is equal to the distance between the holes (13) enabling the two pins (16) being embedded into the two holes (13).

Figure 11:
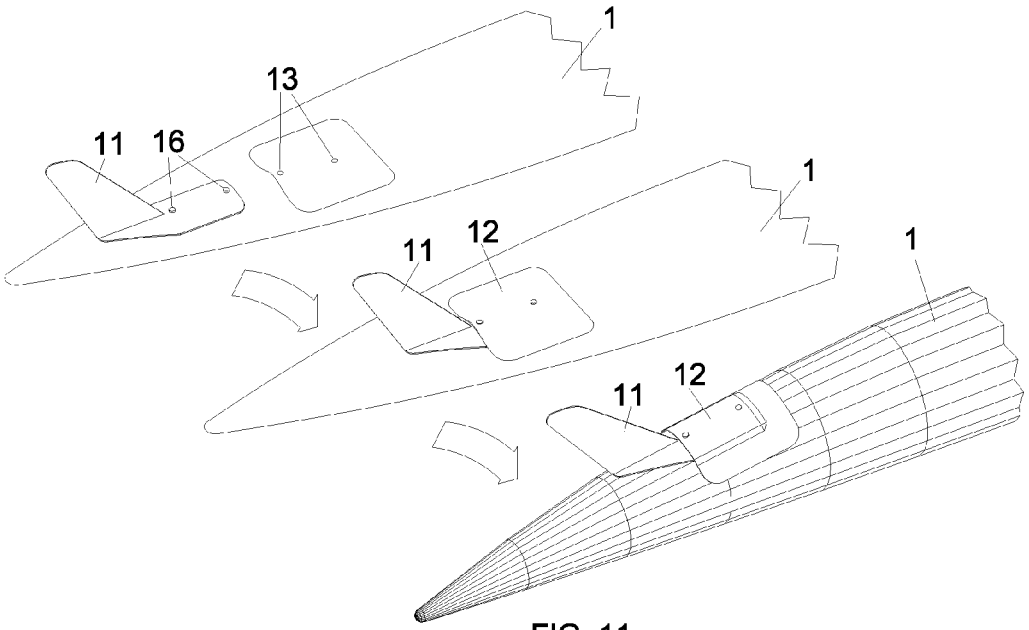
FIG. 11 consists of figures illustrating the principle of installing a removable fin in the float of a boat according to the invention "portable catamaran vessel"

FIG. 11 shows the procedure for installing the removable fin (11) in the float (1). First, with the float (1) deflated or partially inflated, the removable fin (11) can be inserted in the pocket (12), as suggested by FIG. 11, so that the pins (16) can be embedded into the two holes (13), which will ensure the proper alignment and positioning of removable fins (11). Subsequently the float (1) can be inflated, so that the inner region of the pocket (12) presses the cylindrical shell (15) of the removable fin (11), fixing it to the float (1) when inflated. The pins (16) being embedded into the two holes (13) of the pocket (12) ensure the correct alignment, preventing removal of the removable fin (11) while the float (1) remains inflated. For removal of the removable fin (11) should empty the float (1) causing the inner region of the pocket (12) is slack, allowing disengage the pins (16) of the holes (13) and removing the removable fin (11).

Figure 12:
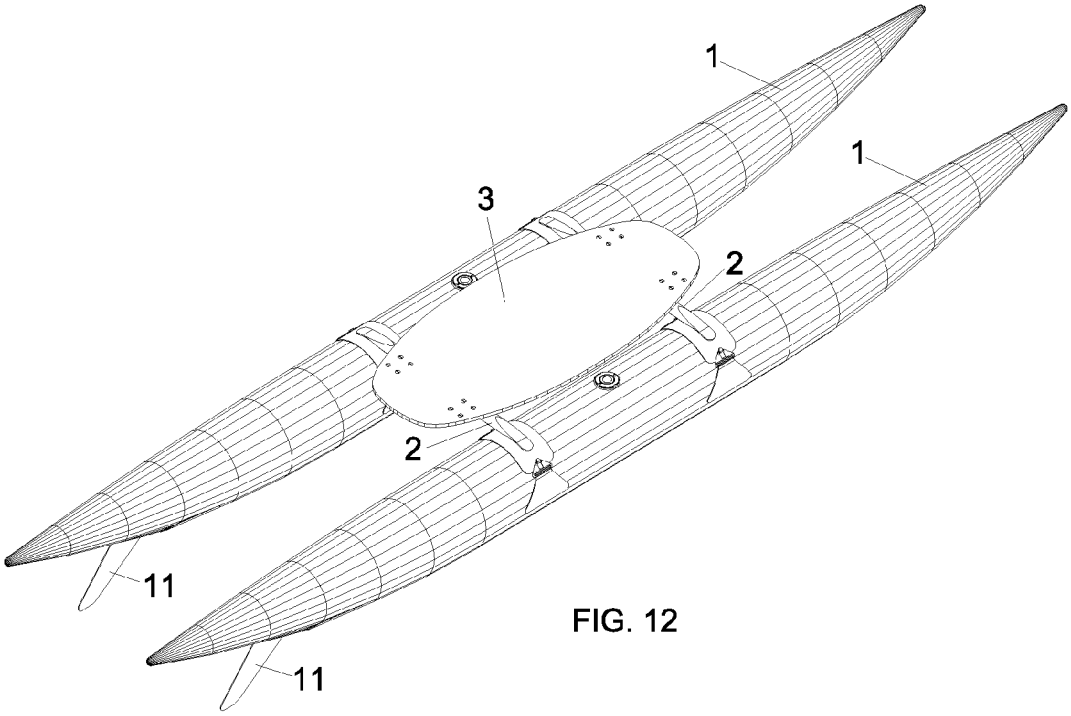
FIG. 12 is a perspective view of a boat according to the invention "portable catamaran vessel" in a fully assembled configuration and with removable fins installed.

FIG. 12 shows a perspective view of the boat completely assembled and removable fins (11) installed.

The invention claimed is:

1. Portable catamaran vessel having floats (1) of inflatable type, characterized by each float (1) having a pocket (12), made of fabric, preferably rectangular and having two holes (13); and pocket (12) is fixed on the float (1) so that their two holes (13) are aligned with the longitudinal axis of the float (1), and the pocket (12) is fixed on the float (1) only in the front and side edges leaving the opening pocket (12) facing the rear end of the float (1) where a removable fin (11) can be introduced; and removable fin (11) is a single body composed of the semi-wing (14) which is fixed to the convex region the cylindrical shell (15) having a region with a curvature and dimensions similar to that assumed by the inner pocket (12) when the float (1) is inflated, and having two pins (16) fixed in the convex region of the cylindrical shell (15) which have the same diameter of the holes (13) inside the pocket (12) and height slightly greater than the thickness of the pocket (12) fabric and the distance between the centers of the pins (16) is equal to the distance between the holes (13), allowing, with the float (1) in a deflated or partially inflated condition, that the removable fin (11) can be inserted in the pocket (12) until the pins (16) can be embedded into the two holes (13) when the float (1) can be inflated, causing the inner region of the pocket (12) press the cylindrical shell (15) of the removable fin (11) attaching it to the float (1).

* * * * *